United States Patent [19]

Würfel

[11] Patent Number: 4,492,623

[45] Date of Patent: Jan. 8, 1985

[54] PROCESS FOR THE HYDROGENATION OF COAL USING A SPLIT FEED

[75] Inventor: Helmut Würfel, Blieskastel, Fed. Rep. of Germany

[73] Assignee: GfK Gesellschaft für Kohleverflüssigung mbH, Saarbruecken, Fed. Rep. of Germany

[21] Appl. No.: 403,651

[22] PCT Filed: Nov. 12, 1981

[86] PCT No.: PCT/DE81/00198

§ 371 Date: Jul. 13, 1982

§ 102(e) Date: Jul. 13, 1982

[87] PCT Pub. No.: WO82/01715

PCT Pub. Date: May 27, 1982

[30] Foreign Application Priority Data

Nov. 14, 1980 [DE] Fed. Rep. of Germany ..... 3042984

[51] Int. Cl.[3] ..... C10G 1/06

[52] U.S. Cl. ..... 208/10

[58] Field of Search ..... 208/10, 108, 107, 8 LE

[56] References Cited

U.S. PATENT DOCUMENTS

| | | | |
|---|---|---|---|
| 1,923,576 | 8/1933 | Krauch et al. | 208/10 |
| 2,639,982 | 5/1953 | Kalbach | 48/197 |
| 4,189,375 | 2/1980 | Kirby et al. | 208/10 |
| 4,364,817 | 12/1982 | Anderson et al. | 208/10 |
| 4,421,632 | 12/1983 | Würfel | 208/10 |

FOREIGN PATENT DOCUMENTS

| | | | |
|---|---|---|---|
| 2651253 | 5/1978 | Fed. Rep. of Germany | 208/10 |
| 2058125 | 3/1983 | United Kingdom . | |

*Primary Examiner*—Delbert E. Gantz
*Assistant Examiner*—Lance Johnson
*Attorney, Agent, or Firm*—Nils H. Ljungman

[57] ABSTRACT

In a process for hydrogenation of coal, where the hydrogenation is performed in the presence of a catalyst and hydrogen under pressure, fresh coal paste is divided into two stream portions which are separately fed into a reaction zone (12). The first stream portion is heated outside of the reaction zone (12) by heat-exchange with gaseous and vaporous hydrogen products, whereas the second stream is heated to the temperature of initiation of hydrogenation within the reaction zone (12) itself, through the transfer of surplus exothermic heat generated in the reaction zone.

6 Claims, 1 Drawing Figure

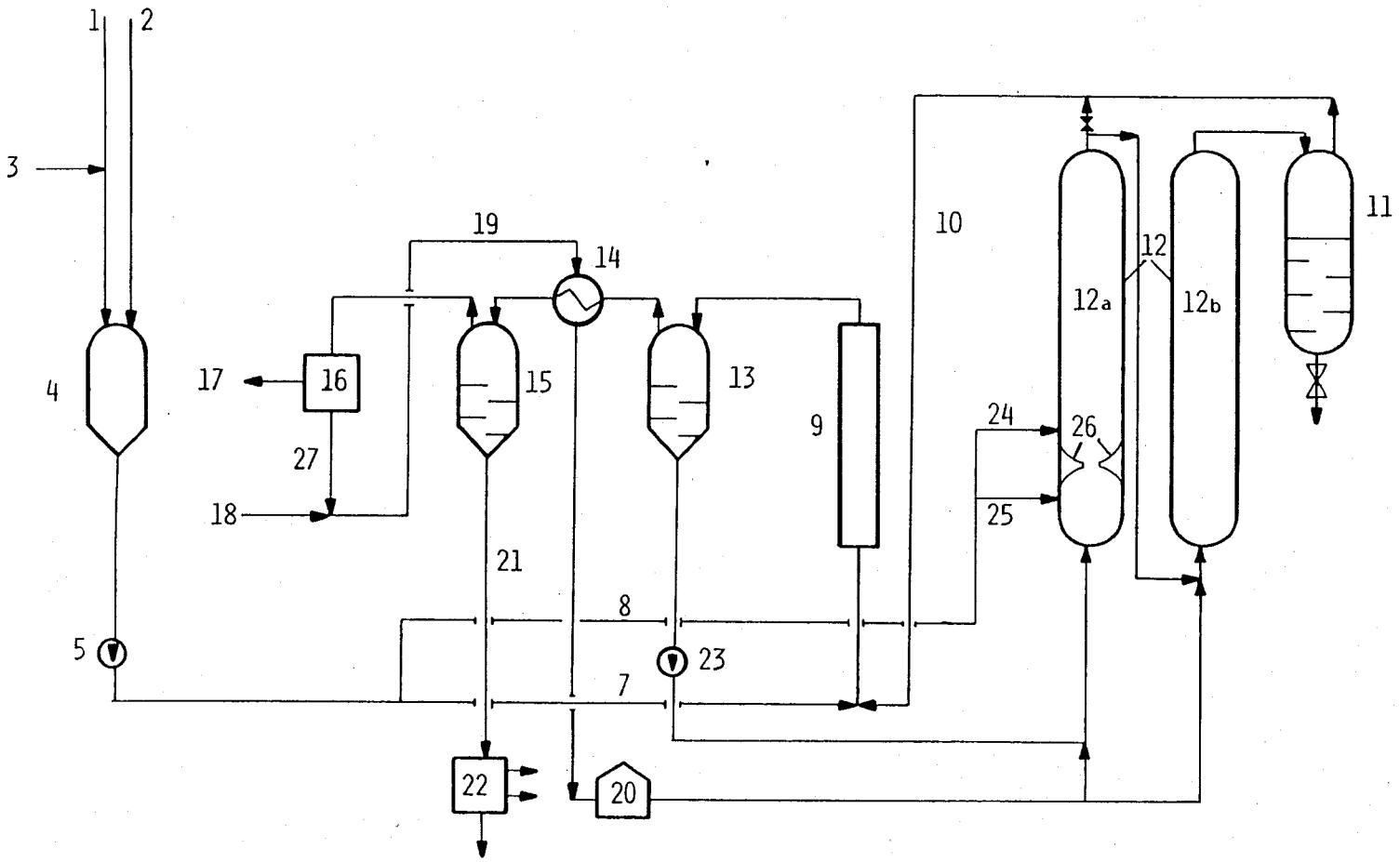
11
12b
12
12a
26
24
25
10
9
13
23
8
7
20
14
15
21
22
19
16
27
17
18
2
1
3
4
5

PROCESS FOR THE HYDROGENATION OF COAL USING A SPLIT FEED

The invention relates to a process for hydrogenation of coal in which coal is mixed to a paste with grinding oil. This paste is then pumped to reaction pressure, heated to the temperature of initiation of hydrogenation and then subjected to catalytically accelerated hydrogenation in the presence of hydrogen in a reaction zone.

A prior art process for hydrogenation of coal is one in which the coal to be processed is dried and finely ground, mixed with grinding oil and the resultant coal paste pumped to reaction pressure. The paste is then initially heated in regenerators in heat exchange relationship with the gaseous and vaporous hydrogenation products and then heated in a pre-heater by adding external heat to attain the temperature of initiation of hdrogenation, and finally hydrogenated in a reaction zone in the presence of hydrogen and a suitable catalyst. The product fraction, leaving the reaction zone, is split or divided in a subsequent hot-separator into a vaporous top fraction consisting of gases, gasolines and distilled oils, as well as into a liquid bottom fraction of non-processed coal, ashes, catalytic particles, other high-molecular substances which are difficult to hydrogenate, such as asphalts, as well as bitumen and heavy oil.

While the top fraction is cooled down by heat exchange with the coal paste and withdrawn from the unit, the heavy oil is divided from the bottom fraction and used as grinding oil for the fresh coal.

One of the disadvantages of this prior art process, among others, is having to heat-up the fresh coal paste with regenerators and pre-heaters.

Because of the viscosity of the coal paste, a uniform utilization of the heat exchanger surfaces in the regenerators is only achieved with difficulty. Especially, the further heating of the coal paste is achieved with difficulty because the coal suspended in the coal paste swells a great deal due to the pre-existing high temperatures thereof. This leads to a further increase in viscosity so that ultimately only a pulsating charge of the coal paste can be fed through the pre-heater, resulting in associated high material abrasion. There can be pressure surges up to 10 bar. It is also possible that coking can occur in the individual heat exchangers at the high temperatures therein.

The object of this invention is to develop a process of the kind mentioned in the beginning of this application, which facilitates the heating of the fresh coal paste substantially to the temperature of initiation of hydrogenation.

In a process of the above mentioned kind, this object is achieved, according to the invention, by dividing the coal paste, which was pumped to pressure, into first and second stream portions and feeding them into the reaction zone, wherein th first stream portion is heated outside of the reaction zone by heat exchange with gaseous and vaporous hydrogenation products, and the second stream portion is heated to the temperature of initiation of hydrogenation, within the reaction zone, by transferring the exothermic surplus-heat produced in the reaction zone.

According to the process as per the invention, the heat of the hot gaseous and vaporous hydrogenation products which are either withdrawn directly at the top of the reaction zone or at the top of a hot separator, immediately subsequent to the reaction zone, is transferred only onto a first stream portion of this paste, not to the overall amount of fresh coal paste as in the state of the art. The first stream portion is thereby dimensioned in such a way that the heat contents of the hydrogenation-vapors, occurring at approximately 470° C., suffice to heat it up to the temperature of initiation of hydrogenation of approximately 420° C. This first stream portion comprises as a rule approximately 50 to 70 percent by weight of the resultant fresh coal paste.

Then the heated stream portion is mixed with the pre-heated hydrogenation-hydrogen and fed into the lower range of the reaction zone.

During coal hydrogenation, a large pert of the exothermic heat of reaction is set free, just at the start of the hydrogenation reactions due to the powerful influence of the hydrogen on the still fresh coal paste. This heat is now used, according to this invention, in the reaction zone itself, for heating the second stream portion to the temperature of initiation of the hydrogenation, by feeding the second stream portion, above the first one, into the reaction zone, into the region where this strong heating effect takes place. There it absorbs the exothermic heat and heats up to the temperature necessary for hydrogenation. The feeding of the second stream portion is best made into the range of the reaction zone where approximately 50% of the complete exothermic reaction heat exists. The second stream portion is added advantageously through several branch conduits arranged on top of each other into the reaction zone, whereby for improved mixing and heat transfer, additional installations can be provided in the feeding range, e.g., concentric flow guides resulting in a constricted reaction zone. Because of this invention, it is possible, with simple means, to heat the resultant coal paste to the temperature of initiation of hydrogenation without troublesome pre-heaters.

It is especially advantageous, if according to a further characteristic of the invention, the heating of the first stream portion is done by direct heat exchange with the hot product vapors. For this, it is first thoroughly mixed with the hot product vapors. Then, the gases and vapors are divided from the resulting mix of gases, respectively, vapors, liquids and solids, and the remaining hot mix of liquids and coal is fed, together with the heated hydrogenation-hydrogen, to the reaction zone.

In this variation of the process, only mixing equipment for direct heat exchange, and a thereafter connected separator, are required. This makes it possible to do without the pre-heater and even the regenerators. The fresh coal paste in the first stream portion can herewith be heated, without any heat exchanger, to the temperature of initiation of hydrogenation. Moreover, the heat losses are substantially reduced because of the direct heat transfer.

A further advantage of the direct heating of the coal paste is that during the heating of the coal paste, the free-water in the coal paste, as well as a portion of the chemically bound water, is driven out from the coal, so that it is almost completely dry. The very expensive, hitherto, traditional drying in the course of re-upgrading of coal can be reduced substantially.

Also, other gases bound in the coal, as for example, methane, ethane, and others, are freed due to the strong heating of the coal which is in direct heat transfer with the hot product vapors. The coal supplied for hydrogenation, after the heat exchange, is thereby almost completely free of gases, so that less gases are formed in the reaction zone itself. This again leads to an increase of the hydrogen partial pressure in the reaction zone, thus improving hydrogenation effectiveness. In comparison to prior art processes, hydrogenation can now be performed at a lower overall pressure, which again leads to savings in investment and operational costs.

Further explanation of the invention can be had from the example schematically shown in the FIGURE.

The FIGURE shows a process for hydrogenation of coal in which the coal to be processed is fed in a conduit 1 to a grinding container 4 and mixed there with preheated grinding oil from the installation, supplied by a conduit 2. The catalysts required for hydrogenation, e.g., compounds of metals of groups IV, VI and VIII of the periodic table, that is, mixtures of these metals, are added through conduit 3 and mixed with the coal by the spraying thereof thereon, respectively. In the grinding container 4, quantities of coal and oil are mixed to a ratio of approximately 70 percent by weight of coal to approximately 30 percent by weight of oil.

The warm coal paste is pumped using a pump 5 to a pressure of approximately 200 bar and then divided into 2 stream portions, the first of which continues through conduit 7 and the second through conduit 8. The first stream portion is fed through conduit 7 into a mixing device 9 and there thoroughly mixed with the hot top product at approximately 470° C. which is supplied by conduit 10 from a hot separator 11 which follows a reaction zone 12 consisting of 2 reactors 12*a* and 12*b* arranged in series; the first stream portion is mixed, if appropriate, also with hot top vapors of reactor 12*a*. Within the mixing device 9 the fresh coal paste heats up to a temperature of 400° C. or higher, due to the direct heat exchange with the hot top product, and thus reaches the temperaturre of initiation of hydrogenation which is a minimum of about 400° C., depending on the coal used.

After the homogenous mixing, the contents of the mixing device 9 are fed into a separator 13 and there split into a gaseous phase and a solids-liquids phase.

The gaseous phase, besides the boiling components of the hot separator top product which has temperature below the temperature occurring in the mixing device, also contains highly volatile gases such as methane, ethane, etc. from the coal. The gaseous phase is further cooled down in a heat exchanger 14, thereby partially condensed and sent to a further separator 15.

The top product of the separator 15 is directed into a washing device 16 and is subjected there to oil washing. Hydrogen-free residual gas is taken out through a conduit 17, while the remaining hydrogen is mixed with fresh hydrogen from a conduit 18, and is then added through conduit 19 first to the heat exchanger 14 and then to an oven 20 for further heating.

The sump product of the separator 15, a fraction mainly of naphtha and medium oil as well as water, flows through conduit 21 into an upgrading unit 22, and is split therein into the various product fractions.

The heated sump product of separator 13, which contains besides fresh coal and grinding oil, also the heavy components of the hot separator top product condensed from mixing device 9, is added to the lower region of reactor 12*a* in reaction zone 12 by means of pump 23, after having been mixed with preheated hydrogen at approximately 450° C. which is supplied from oven 20.

At the start of hydrogenation of this stream portion, the heating effect is especially high because of the strong influence of hydrogen on the still fresh coal, i.e. especially in the lower region of reaction zone 12 where the surplus exothermic heat is especially great. According to the process of the invention, this surplus exothermic heat is now used in reaction zone 12 itself, for heating of the second stream portion of the fresh coal paste to the temperature of initiation of hydrogenation, by feeding it into the reaction zone 12 above the first stream portion through conduit 8 and branch conduits 24 and 25. In this connection, it proves advantageous to install some devices 26, e.g. sheet metal flow guides, in the reaction zone 12, in the region of entry of the second stream portion. These devices contribute to a thorough mixing of the already hydrogenating first stream portion with the still unhydrogenated second stream portion.

With the above described process, it is possible to heat up the resultant fresh coal paste, without the use of regenerators and externally heated pre-heaters, to the temperature of initiation of hydrogenation.

Should it become necessary, in special cases, e.g. with especially slowly reacting coals or because of reasons of temperature control, to supply additional heat to the reaction zone, this heating effect can be provided simply by a more intense heating of the fresh hydrogen in the oven 20.

I claim:

1. A process for the hydrogenation of coal comprising:

(1) forming a coal paste at a first temperature;

(2) pumping said paste to reaction pressure, (3) dividing said paste into first and second portions wherein said first portion comprises about 50 to 70 wt. % of said coal paste;

(4) heating said first portion from said first temperature to about 400°–420° C., the initiation temperature of hydrogenation, by heat exchange with gaseous and vapor products;

(5) introducing the heated first portion into a lower region of a catalytic reaction zone and flowing said first stream upwardly thru said reaction zone wherein said first portion reacts exothermally and produces surplus heat; and (6) introducing said second portion of coal paste at about said first temperature into said reaction zone above the introduction region of said first portion so that said second stream is heated to said hydrogenation initiation temperature by said surplus heat from said first stream reaction.

2. A process according to claim 1, characterized in that the first stream portion, after being heated to the temperature of initiation of hydrogenation, is fed together with hot hydrogen to the lower region of the reaction zone, while the second stream portion is added in at least one location into the reaction zone, above the location where the first stream portion is fed in.

3. A process according to claim 2, characterized in that the second stream portion is fed into the reaction zone through several branch conduits arranged on top of each other in the region of the highest exothermic heat production.

4. A process according to claims 1, 2 or 3, characterized in that devices are provided in the lower range of the reaction zone for homogenous mixing of the two stream portions.

5. A process according to claim 4, characterized in that the heating of the first stream portion is achieved by direct heat exchange with the hot gaseous and vaporous hydrogenation products, wherein it is first mixed homogenously with the hydrogenation product, then the gases and vapors are separated from the resulting mixture of gases respectively vapors, liquids and solids, and then the remaining mixture of liquids and solids is fed into the reaction zone.

6. A process according to claim 1 characterized in that the heating of the first stream portion is achieved by direct heat exchange with the hot gaseous and vaporous hydrogenation products, wherein it is first mixed homogenously with the hydrogenation product, then the gases and vapors are separated from the resulting mixture of gases respectively vapors, liquids and solids, and then the remaining mixture of liquids and solids is fed into the reaction zone.

* * * * *